US010153597B1

(12) United States Patent
Polinski

(10) Patent No.: US 10,153,597 B1
(45) Date of Patent: Dec. 11, 2018

(54) PC BOARD MOUNTED JACK CONNECTOR ASSEMBLY

(71) Applicant: David Polinski, Stuart, FL (US)

(72) Inventor: David Polinski, Stuart, FL (US)

( * ) Notice: Subject to any disclaimer, the term of this patent is extended or adjusted under 35 U.S.C. 154(b) by 0 days.

(21) Appl. No.: 15/707,425

(22) Filed: Sep. 18, 2017

(51) Int. Cl.

| | |
|---|---|
| ***H01R 13/625*** | (2006.01) |
| ***H01R 33/46*** | (2006.01) |
| ***H01R 13/66*** | (2006.01) |
| ***H01R 13/514*** | (2006.01) |
| ***H01R 12/72*** | (2011.01) |
| ***H01R 13/631*** | (2006.01) |
| ***H01R 24/62*** | (2011.01) |
| ***H01R 13/73*** | (2006.01) |

(52) U.S. Cl.
CPC ..... *H01R 13/665* (2013.01); *H01R 12/722* (2013.01); *H01R 13/514* (2013.01); *H01R 13/6315* (2013.01); *H01R 13/73* (2013.01); *H01R 24/62* (2013.01)

(58) Field of Classification Search
CPC ..... H01R 24/58; H01R 24/60
USPC ..... 439/668, 669
See application file for complete search history.

(56) References Cited

U.S. PATENT DOCUMENTS 6,147,850 A * 11/2000 Gronowicz, Jr. ..... H01C 7/021 361/103
6,220,899 B1 4/2001 Ely et al.
6,270,380 B1 8/2001 Shichida et al.
6,923,687 B2 8/2005 Wang
7,438,602 B2 * 10/2008 Montgomery ..... H01R 13/746 439/551
D607,834 S 1/2010 Huang
7,654,872 B2 2/2010 Lin et al.
7,785,119 B1 8/2010 Chiang
7,794,285 B1 9/2010 Huang
7,874,855 B1 * 1/2011 Ye ..... H01R 13/7032 439/188
7,988,498 B1 * 8/2011 Lim ..... H01R 24/58 439/668
8,465,329 B2 * 6/2013 Fields ..... H01R 13/7039 439/188
8,801,476 B2 8/2014 Zhang
8,888,537 B2 * 11/2014 Do ..... H01R 13/187 439/668
9,478,886 B1 * 10/2016 Roberts ..... H01R 13/04
9,680,264 B2 6/2017 Polinski
2002/0119708 A1 * 8/2002 Eisenbraun ..... H01R 24/58 439/668
2007/0232150 A1 * 10/2007 Lee ..... H01R 24/58 439/668
2008/0268703 A1 * 10/2008 Chien ..... H01R 24/58 439/541.5
2008/0299835 A1 * 12/2008 Lin ..... H01R 24/58 439/668
2009/0149080 A1 * 6/2009 Wu ..... H01R 12/57 439/668

(Continued)

*Primary Examiner* — Abdullah Riyami
*Assistant Examiner* — Thang Nguyen
(74) *Attorney, Agent, or Firm* — McHale & Slavin, P.A.

(57) ABSTRACT

Disclosed is a PC board jack assembly that reduces or eliminates signal loss with an audio plug. The jack assembly employs a support housing having a passageway sized to receive the audio plug with connectors to engage the opposite sides of a conventional audio jack. The jack assembly provides secure attachment to a PC board to avoid trace lifting.

11 Claims, 8 Drawing Sheets

(56) References Cited

U.S. PATENT DOCUMENTS

2009/0298347 A1* 12/2009 Wu ..... H01R 13/7033
439/668
2011/0195611 A1* 8/2011 Little ..... H01R 13/52
439/668
2015/0357741 A1* 12/2015 Nazzaro ..... H01R 13/44
439/86
2016/0056591 A1* 2/2016 Zhao ..... H01R 12/721
439/668

* cited by examiner

PC BOARD MOUNTED JACK CONNECTOR ASSEMBLY

FIELD OF THE INVENTION

This invention relates to the field of connectors primarily used for audio signals and, in particular, to an improved jack connector assembly having multiple contacts.

BACKGROUND OF THE INVENTION

Jack plugs are commonly used in connector assemblies for carrying audio signals. The audio jack is the preferred connector for use in the music industry based upon a 6.35 mm (¼ inch) plug diameter, which provides a robust assembly that can be reused indefinitely. However, the conventional jack receptacle is subject to misalignment and wear.

The size of the audio jack makes it easy to grasp without tools, and it cannot be bent if stepped upon or otherwise used in a manner expected of insertion and removal. For this reason, the audio jack is the preferred connector for use with electric guitars, microphones, speakers, amplifiers, line levelers, cell phones, televisions, computers and like equipment found in the consumer and industrial market for analog and digital signal transmission. The audio jack is cylindrical in shape having two, three or four contacts.

Unique to the audio jack is the amount of surface area that is provided by a cylindrical plug. However, the connector to which the plug engages is typically a single prong having a single point of contact. The single point of contact can become problematic, as it needs to press against the plug in order to create a connection. The greater force the contact imparts upon the plug, the better the electrical connection; however, the higher stress placed upon the connector can cause the ground connector to be off center and lose contact. If the electrical contact is slight, the ability to transfer an electrical signal is reduced and the signal can be compromised. The conventional electrical contacts employed to engage the audio plug provide very little contact surface, which results in poor audio quality.

Numerous attempts have been made to improve upon the audio jack. U.S. Pat. No. 7,874,855 describes an audio jack connector having an insulating housing and a passageway. A contacting terminal is disposed on a side of the passageway, having a holding portion and two contacting pieces slanted toward the same side separately from two opposite ends of the holding portion. A first fixing terminal, arranged on a side of the passageway, adjacent to the contacting terminal, has a first fixing slice. The first fixing slice has a side extended obliquely to form a first contacting piece connecting with one contacting piece. A second fixing terminal placed on an opposite side of the passageway has a second fixing slice, a second contacting piece obliquely connected with the second fixing slice for connecting with the other contacting piece. The contacting pieces are forced to slide on and depart from the first contacting piece and the second contacting piece when the contacting terminal is elastically pushed by the inserted plug.

U.S. Publication No. 2007/0232150 describes an audio jack connector including a housing and a set of contacts. The housing has a body, a mating portion extending from one end of the body, and an insertion hole defined in the mating portion and extending inwardly through the body along an axis direction. The set of contacts include signal contacts, a set of switching contacts disposed in the housing, and an exposed contact disposed at the outside of the housing. The switching contacts have a fixed contact and a movable contact. The mating portion of the housing has a cavity defined at an outer surface thereof for receiving a contacting portion of the exposed contact. The contacting portion has a propping block protruding outwardly beyond the outer surface of the mating portion.

U.S. Publication No. 2009/0298347 describes an audio jack connector that is suitable for selectively engaging with either a first multi-pole plug or a second multi-pole plug having more poles than the first multi-pole plug. Each of the multi-pole plugs has a plurality of poles insulated by insulating rings arranged thereinbetween. The audio jack connector includes an insulating housing having a chamber extending inward from a front thereof, and terminal groups. The terminal groups are disposed in the corresponding grooves and project into the chamber. When either of the first and the second multi-pole plugs is respectively inserted into the chamber, the terminal groups are against the multi-pole plug, wherein at least one of the terminal groups is against one of the insulating rings of the first multi-pole plug.

U.S. Pat. No. 6,220,899 discloses a connecting sleeve spring resiliently mounted in a connecting sleeve of an electrical connecting jack. The connecting sleeve spring has an arcuate sinusoid-like side profile, with its two ends curving in a direction opposite the curve of a center contact portion. The center portion has an inwardly angled tongue. When a plug having a collar is inserted into the electrical connecting jack, the collar comes in contact with the tongue and pushes the central contact portion inward, thus forcing the two ends of the connecting sleeve spring to move outward. The two ends press against the inner periphery of the collar.

U.S. Pat. No. 6,270,380 discloses a multipolar electrical connector that, as a counter connector, uses a single-head plug having a pole shaft in which center poles are disposed in plural positions in the axial direction, respectively (hereinafter, referred to merely as "multipolar connector"). In the invention, plural predetermined contact pieces are incorporated into the body, so that plural poles are ensured by the predetermined contact pieces. A required number of first additional contact pieces and second additional contact pieces are placed on the outer and inner peripheral sides of the boss portion, so that two or more poles are ensured by the additional contact pieces. According to the invention, therefore, the number of poles is increased by that of poles which are formed by the additional contact pieces.

U.S. Pat. No. 6,923,687 discloses an audio jack connector comprising a rectangular-shaped insulating housing, and a plurality of different contacts. The insulative housing has a base and a mating portion. A channel extends through the base and the mating portion. A front end of the channel defines a gap, and a number of receiving slits defined on the base at two sides of the channel, the base defining a depression communicating with the channel at a top wall thereof. A first and a second contact are received in the slits. A third contact mates with the top wall and comprises a mounting portion extending beyond the bottom wall of the insulative housing. A fourth contact is installed in a front end of the insulative housing and has an engaging portion extending through the gap and inserted into the front end of the channel for electrically connecting the mating plug connector.

U.S. Pat. No. 7,654,872 discloses an audio jack connector which includes a housing and a terminal group. The housing has an insertion hole extending inward from the front of the housing. The bottom of the base defines at least one signal terminal recess and an auxiliary terminal recess, a first aperture is defined in the bottom of the auxiliary terminal recess and communicates with the signal terminal recess. The terminal group has at least one signal terminal and an auxiliary terminal received in the signal terminal recess and the auxiliary terminal recess respectively. The signal terminal has a contact portion projecting into the insertion hole and an elastic portion extending from the end of the contact portion.

U.S. Pat. No. 7,785,119 discloses an audio jack connector having an insulating housing defining a rectangular base. The base has a passageway passing therethrough for receiving an inserted audio plug connector. A channel is formed at a top surface of the base for communicating with the passageway. A set of switch terminals mounted to the insulating housing comprise an elastic terminal and a fixing terminal. The elastic terminal has a first top plate and a switch arm extended outward from the first top plate, with a free end thereof projecting into the passageway through the channel. The fixing terminal has a second top plate disposed above the channel. The second top plate has a pair of cantilever switch slices extending toward each other and perpendicular to an extending direction of the switch arm, with free ends thereof suspended over the free end of the switch arm and spaced from each other.

U.S. Pat. No. 7,794,285 discloses an audio jack connector for receiving an audio plug connector which includes an insulating housing and a contact terminal. The insulating housing defines an insertion hole from a front end to a rear end thereof for receiving the audio plug connector and a recess communicating with the insertion hole. The contact terminal has a connecting portion received in the recess. Two opposite ends of the connecting portion are extended toward a same side to form a base portion and a first elastic arm. A first contact portion is protruded towards the base portion from a free end of the first elastic arm. A second elastic arm is bent towards the connecting portion from one end of the base portion. A second contact portion is protruded towards the first elastic arm from a free end of the second elastic arm. The first and second contact portions protrude into the insertion hole.

U.S. Pat. No. 8,801,476 discloses an electrical contact of an audio jack connector including a main portion, a soldering portion bending from a lateral edge of the main portion, an elastic portion extending curvedly from a distal end of the main portion to be located above the main portion. The elastic portion has a flexible beam, a first arm extending upwardly from the flexible beam and a second arm curvedly bending from the first arm. The first arm is consistent with a direction along which an audio plug connector is inserted. The second arm is adverse to a direction along which the audio plug connector is withdrawn.

U.S. Pat. No. 8,888,537 discloses an improved electronic audio receptacle connector which employs contacts that have multiple points of contact with a mating audio plug. The contacts each have multiple segments, each segment having a plurality of transverse fingers that interface with a conductive portion of the audio plug. The multiple points of contact improve the reliability of the receptacle connector. The housing of the receptacle connector may be made of two portions mated along an interface. The two portions may have features along the interface to impede moisture ingression and to interlock them together. U.S. Pat. No. D607,834 discloses an ornamental design for a contact of an audio plug connector.

Applicant's U.S. Pat. No. 9,680,264 discloses an audio jack assembly that reduces or eliminates signal loss with an audio jack by use of a support housing having a passageway sized to receive the audio plug with an insulated first connector having first and second terminal strips. Each of the terminal strips are formed integral to a first disk base and positioned to engage the grooved tip of an audio plug when engaged. A second isolated connector includes first and second terminal strips positioned to engage each side of a sleeve when the audio plug is engaged. The second connector is electrically isolated from the first connector, wherein the second connector is fastened to the support housing, securing the first connector therebetween.

Applicant's U.S. patent application Ser. No. 15/263,967 discloses a stereo audio jack assembly that employs a support housing having a passageway sized to receive the audio plug with an insulated first connector having first and second terminal strips, each formed integral to a first disk base and positioned to engage the grooved tip of an audio plug when engaged. A second isolated connector includes a terminal strip positioned to engage one side of an audio plug sleeve when engaged. And a third isolated connector includes a terminal strip positioned to engage another side of an audio plug sleeve when engaged to allow for a stereo connection by having distinct contacts.

What is needed in the industry is a PC Board Mountable Jack Assembly having separate chambers housing two contacts to provide frictional contact along two side surface points of an audio plug.

SUMMARY OF THE INVENTION

Disclosed is a PC board jack assembly for receiving a conventional jack plug comprising a support housing having separated compartments and a central passageway sized to receive the audio plug. The separated compartments include spaced apart contacts to provide dual contact points against the jack plug. The dual contact points maintain the quality of the signal being transferred, providing improved quality of any audio or visual transmission.

An objective of the invention is to provide a PC board jack assembly that reduces or eliminates signal loss between the jack receptacle and a conventional audio plug.

Another objective of the invention is to provide a PC board jack assembly that employs connectors formed integral with a common base to provide a uniform clamp pressure on the sleeve and grooved tip of an audio plug.

Still another objective of the invention is to provide a PC board jack assembly having scalloped terminals for engaging a larger surface area of an audio plug tip to assure a resistance free connection.

Yet still another objective of the invention is to provide a mono or stereo jack assembly design that can be scaled from ¼ inch, ⅛ inch, and micro sizes.

Yet still another objective of the invention is to provide a device that is inexpensive to manufacture yet provides superior audio and visual quality.

Another objective of the invention is to provide a jack assembly that is secured to a board so that the traces cannot be ripped away from the board by moving the male jack side to side. For example, headphones are used extensively wherein plugging the headphones into a PC mounted jack assembly and moving the jack from side to side results in the loosening of the jack assembly. When the jack assembly is loose, it is no longer secure to the PC board and it will lift the traces making it unusable until the traces have been repaired.

Still another objective of the invention is to provide a device that minimizes or eliminates jack assembly movement to avoid trace lifting.

Other objectives and further advantages and benefits associated with this invention will be apparent to those skilled in the art from the description, examples and claims which follow.

DETAILED DESCRIPTION OF THE PREFERRED EMBODIMENT

Figure 1:
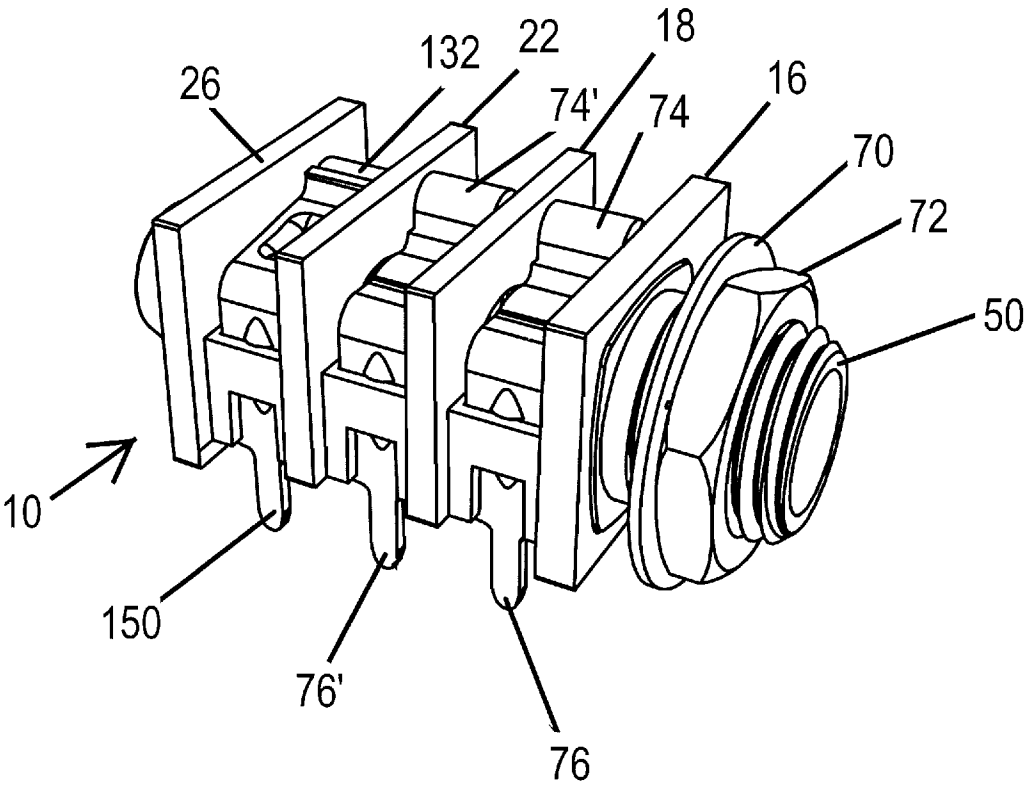
FIG. 1 is a perspective view of the PC board jack assembly.
Figure 2:
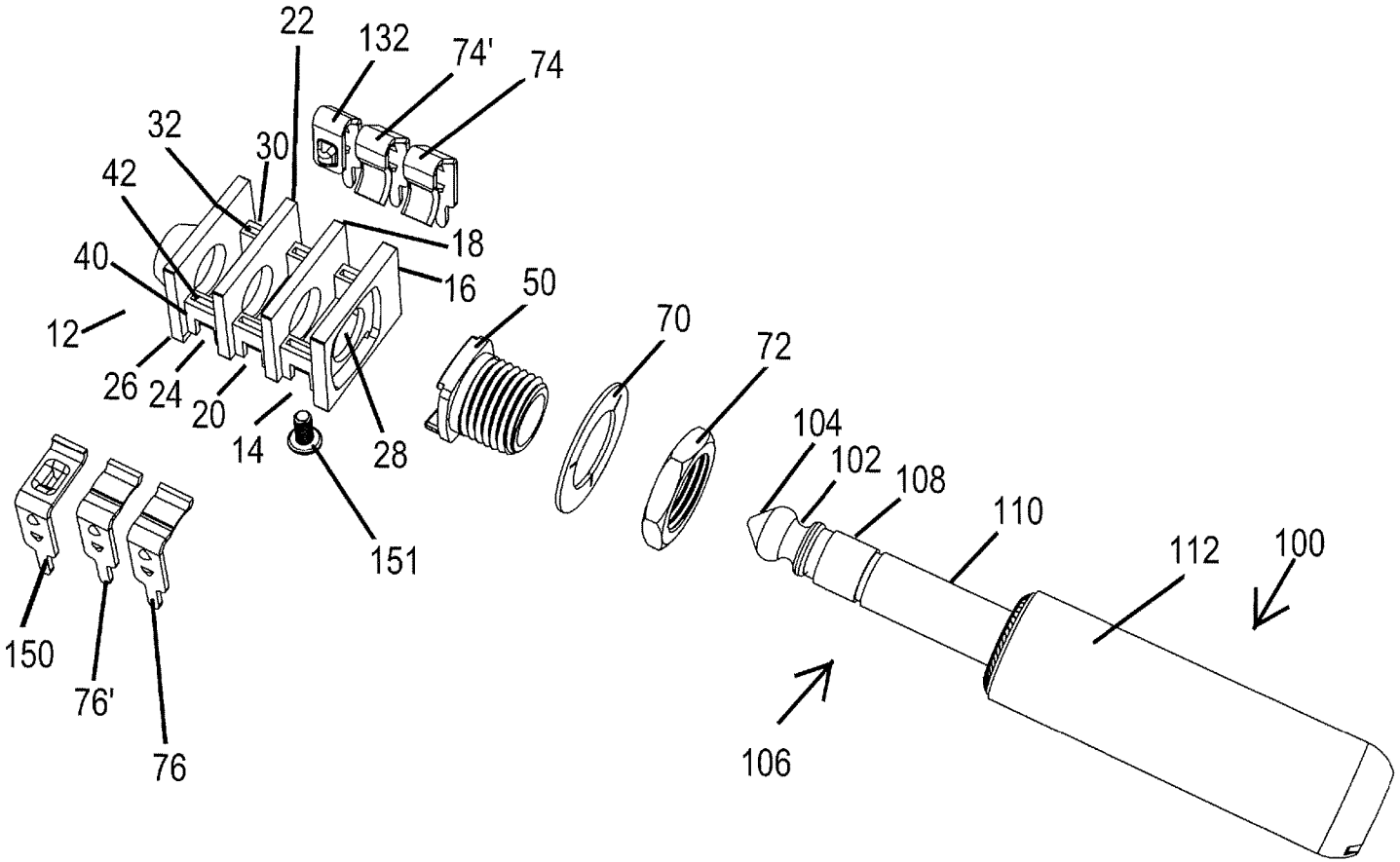
FIG. 2 is an exploded view thereof with an audio jack.
Figure 3:
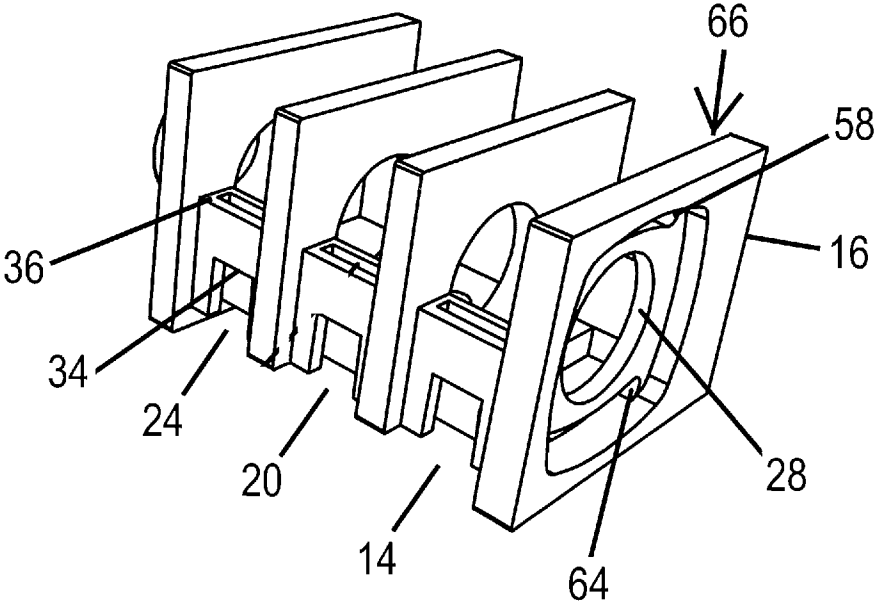
FIG. 3 is a perspective view of the support housing.
Figure 4:
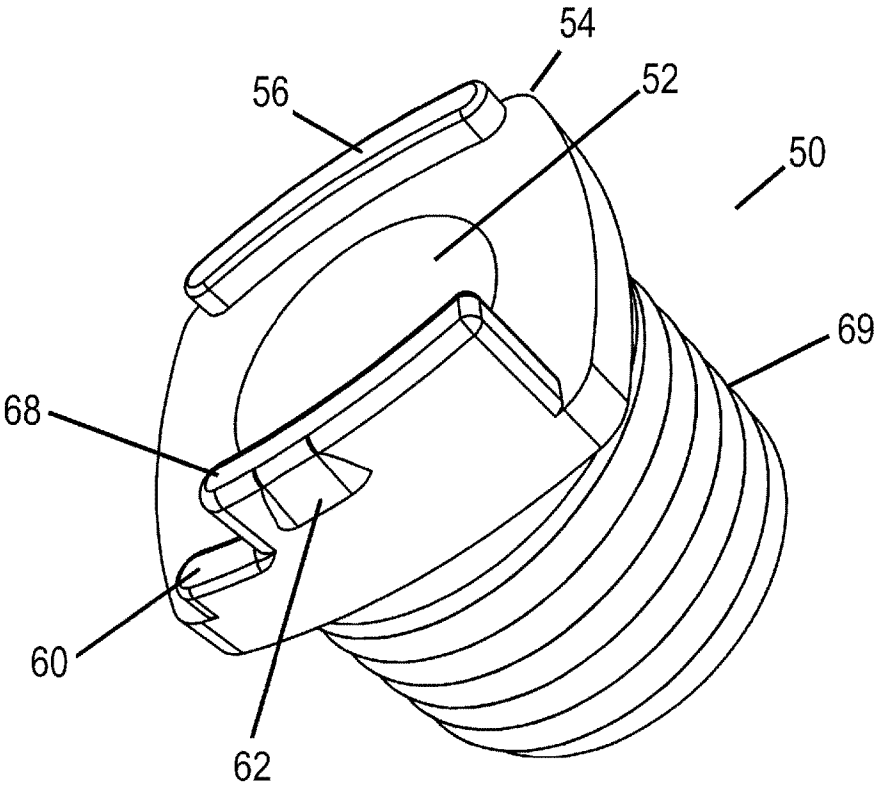
FIG. 4 is a perspective view of the threaded barrel.
Figure 5:
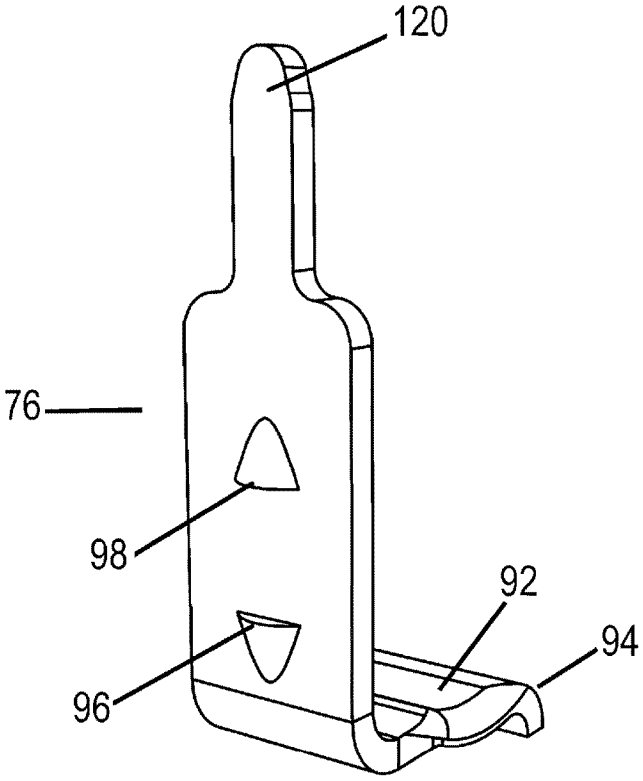
FIG. 5 is a perspective view of an inner contact for the jack shank.
Figure 6:
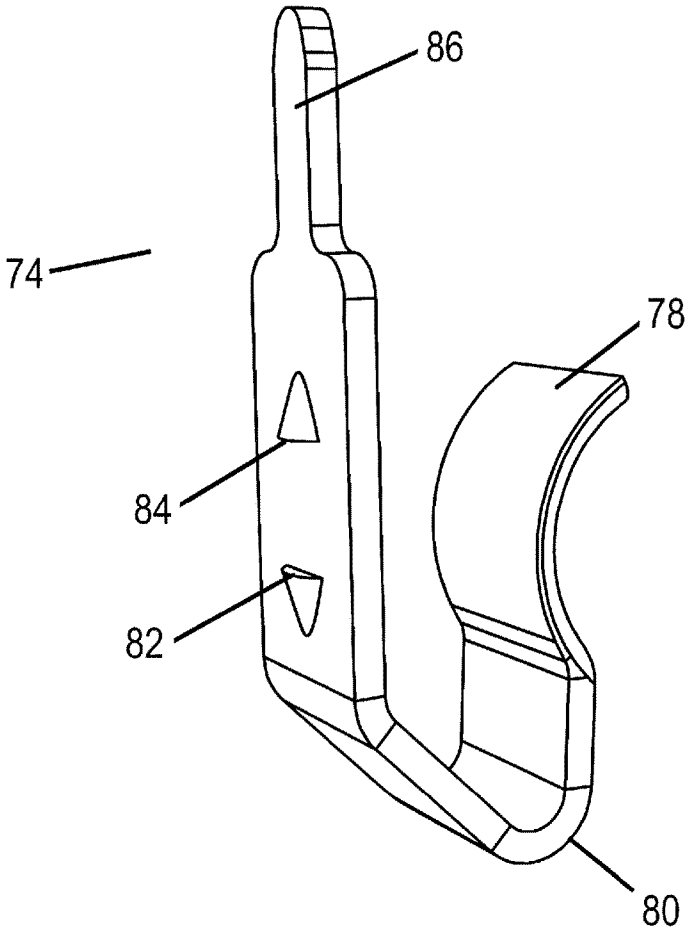
FIG. 6 is a perspective view of the outer contact for the jack shank.
Figure 7:
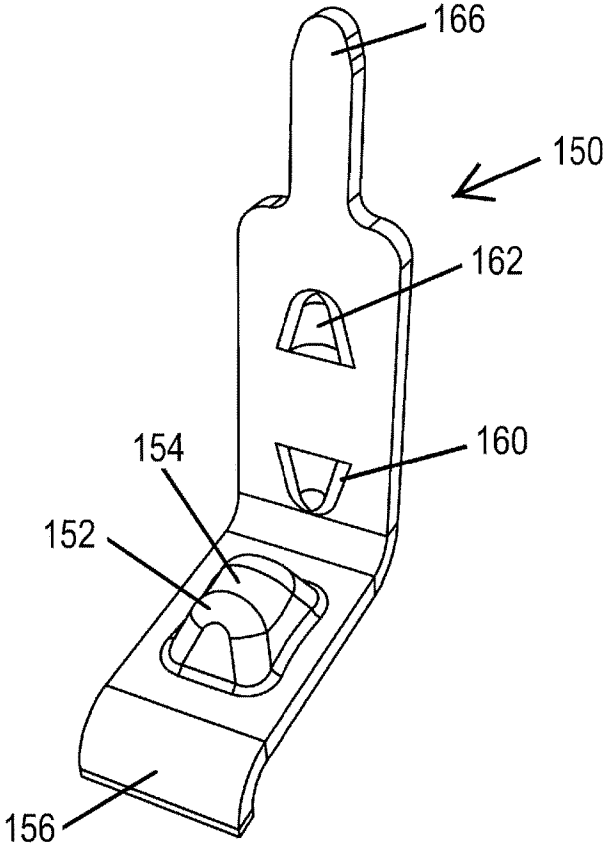
FIG. 7 is a perspective view of the outer contact for the jack tip.
Figure 8:
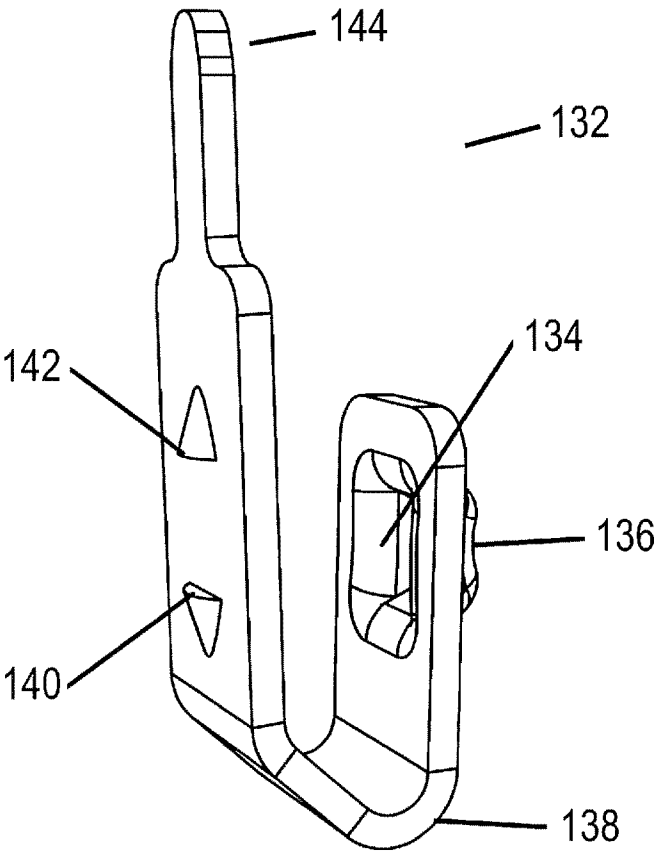
FIG. 8 is a perspective view of the inner contact for the jack tip.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to the drawings, set forth is a PC Board jack assembly 10 for receiving a conventional audio plug. The preferred audio plug is a conventional 6.35 mm (¼ inch) plug that has been an industry standard for over a century. The conventional audio plug 100, includes a groove 102 formed along a tip 104, which operates as a detent and is commonly used for securing the audio plug into a receiving jack assembly. The shank of the audio plug 100 may include a first portion 108 isolated from a second portion 110, allowing the plug to be used in either a mono or stereo embodiment. The base 112 of the plug is typically enlarged to allow an individual to easily grasp the plug for insertion or removal from a jack receptacle.

The PC board jack assembly 10 consists of a support housing 12 defined by a first compartment 14 formed from a front end wall 16 and a first side wall 18. A second compartment 20 is formed from the first side wall 18 and a second side wall 22. A third compartment 24 is formed from the second side wall 22 and an end wall 26. The support housing 12 has a centrally disposed aperture 28 extending through the three compartments. Each compartment 14, 20, 24 is spaced apart from adjoining side walls by a first spacer wall 30 formed on a first side; the first spacer wall 30 having a slot 32 for receipt of a U-shaped terminal connector. The first spacer wall 30 further has a lower edge 34 and an upper edge 36 defining a height for use in capturing protrusions formed on each terminal connector, as will be explained later in this specification. Similarly, a second spacer wall 40 having a slot 42 for receipt of an L-shaped terminal connector has a lower edge 34 and an upper edge 36 defining the height for capturing of protrusions formed on each terminal connector. For simplicity in the drawings, the spacer walls in each compartment are identical, for this reason they will be numbered the same to avoid drawing congestion. The support housing is constructed from non-conductive materials, preferably plastic.

A threaded barrel 50 is attached to the front end wall 16. The threaded barrel has a central aperture 52 sized for receipt of the audio jack shank 106. A barrel lip 54, having a first alignment tab 56, is insertable into receptacle 58 formed in the first end wall 16; and a second alignment tab 60, having a locking protrusion 62, is insertable into receptacle 64 of the first end wall 16. The locking protrusion 62 is pushed through the receptacle 64 to engage the inner surface 66 of first end wall 16, securing the threaded barrel to the support housing 12. The upper end 68 of the second alignment tab 60 is available to contact the first terminals, as explained hereinafter. The threads 69 operate in conjunction with washer 70 and threaded fastener nut 72 for securely fastening the jack assembly 10 to a PC board.

A first inner contact 74 is positioned within the first compartment 14. The first inner contact 74 is defined by a U-shaped inner contact 74 having a lower portion 78 conforming to the shank 106 of an audio jack, and an upper portion 80 providing a bridge surface or contact surface to interface with an L-shaped outer contact 76. The first inner contact 74 has an upper protrusion 82 and a lower protrusion 84 for capturing of the spacer wall 30. The terminal end 86 is insertable into slot 32 of the spacer wall 30, wherein the protrusions 82 and 84 lock the first inner contact 74 to the housing. An electrical connection, not shown, is securable to the terminal end 86.

The first outer L-shaped contact 76 has a lower portion 92 conforming to the side of an audio jack and an upper portion 94 electrically coupling to the bridge surface 80 of the first inner contact 74. An upper protrusion 96 is spaced apart from a lower protrusion 98 for locking the contact to the support housing 12. The terminal end 120 is insertable through the slot 42, wherein protrusions 96 and 98 engage the spacer wall 40 and lock the first outer contact 76 to the support housing 12. An electrical connection, not shown, is securable to the terminal end 120. Securing an electrical connection to both terminal ends 86 and 120 provides redundancy in the electrical connection should a wire or contact be damaged. A second outer contact 76' is positioned within the second compartment 20. The second outer contact 76' is identical to the first outer contact 76. For simplicity, the explanation of the first outer contact 76 applies to the second outer contact 76'.

A second inner contact 74' is positioned within the second compartment 20. The second inner contact 74' is identical to the first inner contact 74. For simplicity, the explanation of the first inner contact 74 applies to the second inner contact 74.

A third inner contact 132 is positioned within the third compartment 24. The third inner contact 132 is defined by a U-shaped inner contact 132 having a lower portion 134 conforming to the groove 102 of an audio jack by use of a scallop end 136. An upper portion 138 provides a bridge surface or contact surface to interface with an L-shaped outer contact 150. The third inner contact 132 has an upper protrusion 140 and a lower protrusion 142 for capturing of the spacer wall 30. The terminal end 144 is insertable into slot 32 of the spacer wall 30, wherein the protrusions 140 and 142 lock the third inner contact 132 to the support housing 12. An electrical connection, not shown, is securable to the terminal end 144.

The third outer L-shaped contact 150 has a lower portion 152 conforming to the side of an audio jack by use of a scallop shape 154. An upper portion 156 is electrically coupled to the bridge surface 138 of the inner contact 132. An upper protrusion 160 is spaced apart from a lower protrusion 162 for locking the contact 150 to the support housing 12. The terminal end 166 is insertable through the slot 42, wherein protrusions 160 and 162 engage the spacer wall 40 and lock the third outer contact 150 to the support housing 12. An electrical connection, not shown, is securable to the terminal end 166. Securing an electrical connection to both terminal ends 144 and 166 provides redundancy in the electrical connection should a wire or contact be damaged.

The U-shaped inner contacts 74, 74' and 132 provides constant biasing effect against the shank of the audio plug. The L-shaped outer contacts 76, 76' and 150 provides biasing from another direction, wherein the contacts each apply pressure independent of each other. The U-shaped and L-shaped contacts work together, wherein the cost of manufacturing is reduced by forming the independent contacts as disclosed. The contacts, threaded barrel and fastening nut are preferably constructed from copper alloy, nickel plated. The support housing is preferably constructed from ABS plastic. A mounting screw 151 can be used to secure the support housing to a frame. The jack assembly provides secure attachment to a PC board to avoid trace lifting.

The term "coupled" is defined as connected, although not necessarily directly, and not necessarily mechanically. All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art, which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A PC board jack assembly for receiving a conventional audio plug comprising:

a support housing defined by a first compartment formed from a front end wall and a first side wall, a second compartment formed from said first side wall and a second side wall, and a third compartment formed from said second side wall and an end wall, said support housing having a centrally disposed aperture extending through each said compartment;

a threaded barrel attached to said front end wall;

a first inner contact and a first outer contact positioned within said first compartment constructed and arranged to contact two side surfaces along a first portion of the audio plug;

a second inner contact and a second outer contact positioned within said second compartment constructed and arranged to contact two side surfaces of a second portion of the audio plug; and a third inner contact and a third outer contact positioned within said third compartment constructed and arranged to contact two side surfaces of a tip on the audio plug; said first and second inner contacts having a lower portion conforming to the audio jack with an upper portion of each said first and second inner contacts providing a bridge surface, and said first and second outer contacts having a lower portion conforming to the audio jack with an upper portion of each said first and second outer contacts electrically engaging a bridge surface of an adjoining inner contact.

2. The jack assembly according to claim 1 wherein said support housing is constructed of a non conductive material.

3. The jack assembly according to claim 2 wherein said non conductive material is injection molded plastic.

4. The jack assembly according to claim 1 wherein said first and second inner contact is U-shaped and includes an upper raised protrusion for positioning above a chamber spacer wall and a lower raised protrusion for positioning below a chamber spacer wall for locking said inner contact to said support housing.

5. The jack assembly according to claim 1 wherein said first and second outer contact is L-shaped and includes an upper raised protrusion for positioning above a chamber spacer wall and a lower raised protrusion for positioning below a chamber spacer wall for locking said outer contact to said support housing.

6. The jack assembly according to claim 1 wherein said first and second inner contacts are interchangeable.

7. The jack assembly according to claim 1 wherein said third inner contact is U-shaped having a lower portion with a protrusion conforming to the grooved tip of an audio jack and an upper portion providing a bridge surface, and said third inner contact having a lower portion with a protrusion conforming to the grooved tip of an audio jack and an upper portion electrically coupling to said said third outer contact.

8. The jack assembly according to claim 7 wherein said third outer contact is L-shaped and includes an upper raised protrusion for positioning above a chamber spacer wall and a lower raised protrusion for positioning below a chamber spacer wall for locking said third outer contact to said support housing.

9. The jack assembly according to claim 1 wherein said threaded barrel includes a protrusion for coupling to said front end wall.

10. The jack assembly according to claim 1 wherein said threaded barrel electrically couples to said first inner and outer contact.

11. The jack assembly according to claim 1 wherein said threaded barrel is for receipt of a threaded fastener, wherein said fastener and threaded barrel are used to secure said jack assembly to a fixed frame.

* * * * *